US009198833B2

(12) United States Patent
Schwarz et al.

(10) Patent No.: US 9,198,833 B2
(45) Date of Patent: Dec. 1, 2015

(54) METHOD AND DEVICE FOR ORAL APPLICATION OF A COMPOSITION

(75) Inventors: Franz Xaver Schwarz, Kundl (AT); Szabolcs Szerdi, Kundl (AT)

(73) Assignee: SANDOZ AG, Basel (CH)

( * ) Notice: Subject to any disclaimer, the term of this patent is extended or adjusted under 35 U.S.C. 154(b) by 424 days.

(21) Appl. No.: 13/144,143

(22) PCT Filed: Jan. 15, 2010

(86) PCT No.: PCT/EP2010/050441

§ 371 (c)(1),
(2), (4) Date: Sep. 12, 2011

(87) PCT Pub. No.: WO2010/081867

PCT Pub. Date: Jul. 22, 2010

(65) Prior Publication Data

US 2011/0319867 A1 Dec. 29, 2011

(30) Foreign Application Priority Data

Jan. 15, 2009 (EP) ..... 09150606

(51) Int. Cl.
*A61J 7/00* (2006.01)

(52) U.S. Cl.
CPC .. *A61J 7/00* (2013.01); *A61J 7/0015* (2013.01)

(58) Field of Classification Search
CPC ..... A61J 7/00; A61J 7/0015; A61J 7/0046; A61J 9/006; A61J 7/0023; A47G 21/004; A47G 19/16; A47G 21/183
USPC ..... 604/514, 516, 77, 92, 310
See application file for complete search history.

(56) References Cited

U.S. PATENT DOCUMENTS 3,589,823 A * 6/1971 Hendrickson ..... 401/176
5,028,435 A * 7/1991 Katz et al. ..... 424/484
(Continued)

FOREIGN PATENT DOCUMENTS

| | | | |
|---|---|---|---|
| WO | 02102182 | A2 | 12/2002 |
| WO | 2005107713 | A2 | 11/2005 |
| WO | 2008134667 | A2 | 11/2008 |

OTHER PUBLICATIONS

International Search Report and Written Opinion (mailed Jun. 9, 2010) and International Preliminary Report on Patentability (completed Apr. 26, 2011).

*Primary Examiner* — Aarti B Berdichevsky
*Assistant Examiner* — Laura Schell
(74) *Attorney, Agent, or Firm* — Jeffrey S. Melcher; Manelli Selter PLLC

(57) ABSTRACT

The invention relates to a device for oral application of a composition. The device comprises recess having an outer rim encompassing the recess. Within the recess, a composition is arranged. The composition comprises a gelling agent and an active agent. A cover member is attached to the rim and completely covers the recess. Thus, the cover member, together with the recess, retains the composition within the recess. The cover member has an outer surface opposed to an inner surface adjoining the recess. In order to allow preparation of the composition by adding water without the risk of losing some of the composition during preparation, the cover member comprises one or more openings for providing fluidic connection between the inner surface and the outer surface. Through this opening, water can enter for preparing the composition meanwhile the cover retains all composition within the recess. The invention further relates to a method for manufacturing the device. The solid composition is introduced into the recess and the cover member is attached to the rim. The method further comprises to provide the cover member with one or more openings. The openings are adapted for providing fluidic connection between the inner surface and the outer surface of the cover member.

14 Claims, 2 Drawing Sheets

(56) References Cited

U.S. PATENT DOCUMENTS

| | | | | |
|---|---|---|---|---|
| 5,123,915 | A * | 6/1992 | Miller et al. | 606/234 |
| 5,993,413 | A * | 11/1999 | Aaltonen et al. | 604/77 |
| 7,461,992 | B2 * | 12/2008 | Griffon | 401/266 |
| D585,626 | S * | 2/2009 | Chappell et al. | D1/102 |
| 7,866,907 | B2 * | 1/2011 | Cable et al. | 401/134 |
| 8,156,599 | B2 * | 4/2012 | Waguespack et al. | 15/104.94 |
| 2007/0186944 | A1 * | 8/2007 | Strickland et al. | 131/361 |
| 2008/0317911 | A1 * | 12/2008 | Schleef et al. | 426/103 |
| 2009/0025741 | A1 * | 1/2009 | Crawford et al. | 131/359 |

* cited by examiner

METHOD AND DEVICE FOR ORAL APPLICATION OF A COMPOSITION

CROSS-REFERENCE TO RELATED APPLICATIONS

This application is a national stage entry under 35 U.S.C. 371 of International Application No. PCT/EP2010/050441, filed 15 Jan. 2010, designating the United States. This application claims foreign priority under 35 U.S.C. 119 and 365 to European Patent Application No. 09150606.3, filed 15 Jan. 2009. The complete contents of these applications are incorporated herein by reference.

TECHNICAL FIELD OF THE INVENTION

The present invention relates to oral application of a composition with an active pharmaceutical ingredient, and in particular to a device for oral application of a composition and a method for manufacturing the device and device for the oral application of substances and a method for filling the device.

TECHNICAL BACKGROUND

The oral administration of pharmaceutical formulations comprising an active pharmaceutical ingredient with an unpleasant taste remains a technical challenge. However, treatment of diseases often requires to ingest substances comprising an active agent. Certain agents for oral application have an unwanted taste. In addition, some agents have to be applied in substantial amounts. Further, it is important to deliver a predefined dosage, any agents remaining on the delivery device or being spilled substantially impair the desired medical or nutritive effect. Since a number of active substances can not be stored for a long time if dissolved with or exposed to water and have to be stored in dry condition, the composition is delivered in water-free form. This requires the patient to add water before application. Since the patient is required to prepare the formulation by adding water, the formulation and any means for application are required to be easy to handle and should not lead to a wrong dosage, if the patient inaccurately uses the means for application.

According to a first approach, the formulations are applied in semi-solid form, i.e. in the form of a gel or with the consistence of a pudding in order to reduce the effect of the unwanted taste. Thus, the active agent is combined with a gelling agent providing the semi-solid consistence. Further, this can be combined with substances for taste masking which are added to the formulation. In particular, taste masking is effective when combined with a semi-solid texture of the formulation. For administering, water is added to the combination of active composition and gelling agent. Due to the sensitivity with regard to water, the semi-solid formulation can not be stored for a long time, and, consequently water has to be added by the patient upon application.

In WO 2005/107713 A2 a solution according to a first approach is described. A spoon is disclosed, which contains the active composition combined with e.g. Gellan gum. For storing, the spoon is sealed with a "peel-off" film, which encloses the active composition (and the Gellan gum) together with the sealing layer. Upon application, the peel-off film is completely removed before water is added. The added water takes a certain time period (typically 5 min) to enter the gum and to build the semi-solid form within the opened spoon. After this time period, the formulation can be applied.

In this formulation, the active composition and the gum form one solid body attached to the spoon to obviate the loss of any active composition before and during the application and during the absorption of water. Thus, the solid body containing the gum has low specific surface areas involving a long diffusion/absorption process during which the water enters the gum. However, since all of the active composition has to be attached to the spoon to avoid spoiling, no structure for the active substance/gum can be selected enabling a shorter diffusion process. In particular, during this (necessarily) long diffusion/absorption process, neither dissolved amounts of active composition nor dissolved amounts of gum are secured against spoiling. Since the spoon presents the semi-solid formulation at an open surface, any accidental move or agitation, even very light impacts, bear the risk of spoiling a part of the formulation. In particular, tilting the spoon after some water has changed the formulation to a semi-solid state leads loss of the formulation. Since the formulation is given in a predefined amount related to e.g. to a single dosage, this would lead to an incorrect dosage applied to the patient.

According to a second approach, the substance relevant to nutrition or to medical treatment is given as powder or in granular form. For application, a consumable fluid like water or fruit juice is added and, together with the substance, forms a suspension. Firstly, the substance provided as powder or in granular form induces the risk of spilling a part of the substance. Secondly, a part of the substance might adhere to the application device, e.g. the bottom of a drinking glass or a spoon used for introducing the substance and for stirring. Further, a part of the substance might remain in the application device due to sedimentation of the substance. Therefore, this approach bears the risk of unpersuasively reducing the dosage. Further, parts of powder or granules can easily be spilled even by careful handling. In particular this is the case when applying the substance to children or handicapped persons.

Both, the first and the second approach show bear the risk of unpersuasively reducing the dosage and require high attention upon preparation.

Therefore, it is an object of the invention to provide a device for oral application which is easy to handle, and in particular having a reduced the risk of spoiling active agent upon preparation.

SUMMARY OF THE INVENTION

This object is solved by subject-matter of the independent claims.

The underlying concept of the invention is to retain a composition (comprising an active composition and a gelling agent) within the inventive device by a cover during the absorption of fluid (i.e. water) by the gelling agent. According to the invention, the cover is adapted to be removed after the preparation of the composition and right before oral application. This is provided by a cover on the device, the cover having at least one opening for conducting water into a recess formed by the device, the cover retaining the composition during the conversion to a semi-solid (and during storage). Therefore, the cover provides both: an inlet for water at the start of the preparation and a retaining element retaining the prepared or unprepared composition until the prepared composition is applied to the patient's mouth. According to a first aspect, the cover is not permeable for the composition (which can be provided by suitable particle sizes), and is permeable for a fluid (liquids comprising water, e.g. drinks) to be absorbed by the gelling agent). According to a second aspect, the cover is considered as a retainer for solid formulations comprising an active agent and a gelling agent in water-free form as well as in semi-solid form. At the same time, this retainer (for solid or semi-solid particles or substances) provides an inlet or a fluid path for water or other liquids converting water-free (liquid-free) a composition comprising gelling agent into semi-solid a composition. Since the inlet (i.e. the opening) can have nearly any shape, and, in particular, can be structured with very small dimensions without losing the ability to conduct water into the device, the structure of the composition can be nearly randomly selected without the risk of accidentally removing composition through the inlet from the inside of the device. Summarized, the cover takes advantage of the distinct physical states and properties of the solid composition and the water swelling the composition by selectively retaining the solid composition and allowing water to pass the opening towards the solid composition. Thus, in any case, the composition is retained by the cover (until the cover is released), while the cover allows to change the state of the composition from solid to semi-solid by allowing water to contact the composition, e.g. if the device is immersed into water. The device, together with the composition, forms a system providing a retaining function (implemented by the cover member), a liquid (e.g. water) feeding function (implemented by the opening(s)), a gelling function (implemented by the gelling agent within the substance), a supporting function (implemented by the recess receiving both, the composition and the liquid) as well as an application function (implemented by the recess, if the cover member has been removed).

Therefore, with regard to the prior art, the invention provides two main advantages. Firstly, the composition is securely locked within the device during preparation and is released just before the composition is applied. This simplifies the preparation of the formulation by the patient and does not require high attention by the patient to ensure the application of the complete amount of the composition. Secondly, the composition can be provided in nearly any structure, in particular structures with a high specific surface area like a bulk of small particles, in contrast to the continuous block used in the prior art. Due to the high specific area, the water can be absorbed very rapidly. This drastically reduces the preparation time of the formulation. In this way, the invention enables instant preparation. The composition can be provided in nearly any structure as long as it is given that the smallest particle of the composition is greater than the largest clearance of all openings or inlets in the cover, the cover thereby retaining the complete amount of composition until being removed. Depending on the composition, this flexibility in particle size can reduce one or more manufacturing steps. In particular, the composition does not have to be prepared with a certain particle size or as a block.

In the context of the invention, the term composition denotes a composition comprising at least an agent and a gelling agent. The composition can further comprise additives and is in dry form. The composition is on form of solid or semi-solid particles, e.g. in granular form as pellets or other. The form of the particles is adapted to the shape of the openings(s) of the cover member such that the opening retains the particles within the recess. Further, the consistency of the particles (solid or semi-solid) results in the retaining effect of the cover member. In an exemplary embodiment, the composition is in form of micro-capsules comprising at least one agent and a cover layer encapsulating the at least one agent (and, if applicable at least one additive). The agent comprises at least one pharmaceutically active agent or at least one nutrition supplement or a combination thereof. As gelling agent, at least one gelling agent is denoted having the capability of gelling upon contact with a liquid. In the context of the invention, the term liquid denotes any consumable liquid adapted to generate a gelling process upon contact with the gelling agent. In particular, liquid comprises water with or without additional substances like flavor. As preferred embodiment, the liquid comprises juice or any other consumable drink. The liquid and the gelling agent provide a system in that the liquid is adapted to provoke a gelling process within the gelling agent and in that the gelling agent is suited for gelling upon contact with the liquid. In an embodiment, the composition comprises at least one additive. The at least one additive comprises: at least one binder substance, at least one filler substance, at least one flavor substance, at least one absorption enhancement substance, at least one preservation substance, at least another additive, alone or in any combination thereof. Further definitions of these terms are given below.

According to a first aspect of the invention, the inventive device comprises a recess as well as a composition arranged within the recess, the composition comprising a gelling agent. The composition further comprises one or more pharmaceutically active agents, optionally in combination with other additives. As active agents, one or more drugs or nutrition supplements or combinations thereof can be used. The composition can be provided by one chemical compound or by a mixture of a plurality of compounds. The composition comprises at least an active agent, a gelling agent and, optionally, a filler composition or a binder composition, or other additives or any combination thereof. The recess is covered by a cover member, the space inside the recess being completely enclosed by an inner surface provided by the recess and by the cover member, which is arranged in opposition to the inner surface of the recess. The composition is retained within the recess by the cover member (and by the inner surface of the recess). According to the invention, the cover member comprises one or more openings extending through the cover layer. The openings provide an inlet for water to be supplied to the composition. Preferably, the openings are void and provide a fluidic connection from outside into the recess through the cover member or are obstructed by water-dissolvable material which provides a fluidic connection into the recess for water, the water dissolving the water-dissolvable material thereby opening the fluidic connection. According to the invention, the openings are adapted for providing fluidic connections through the cover member either by a continuous fluidic connection or by a fluidic connection which is obstructed by water-dissolvable material which enables the fluidic connection upon contact with water.

The cover member is provided as cover layer which is attached to the recess. The recess comprises an outer rim onto which the cover member or the cover layer is attached to. The outer rim can be provided by the end face of the recess and, further, can be provided by a flange or another attachment member being part of or being connected with the recess and providing an attachment surface in form of a ring onto which the cover member is mounted. The ring is not delimited to an exactly circular shape. Rather, the ring can be of any shape, according to the shape of a boundary of the recess. The width of the attachment surface (the distance between inner and outer dimension of the ring) is preferably greater than a minimum width for each point of the rim and, preferably, has a substantially constant width in any radial direction of the rim.

The cover member is provided as a thin layer directly abutting to the recess, i.e. to the outer rim and comprises a non-irritating, pharmacologically acceptable material at least at the surface adjoining to the inner space of the recess. The cover member is connected to the recess or to the outer rim by pressing under heat, by a welding connection or by an adhesive bond. In a particularly preferred embodiment, the cover member is a cover layer made of a thin aluminum foil or by a thin foil of plastics covered by an aluminum layer adjoining the recess, wherein the connection between the cover layer and the recess is provided by a combination of welding and pressing the layer to the rim.

The recess is preferably formed by a bowl or any other cavity forming element. The concave form of the recess provides an inner space in which the composition is arranged. The recess is preferably formed by non-irritating, pharmacologically acceptable materials at least at the surface adjoining the inside of the recess. In a particularly preferred embodiment, the recess is formed by a bowl in the shape of a spoon formed by a thin layer of moulded plastics. The thin layer forming the bowl of the recess can have a thickness of 5 mm-0.05 mm, 2 mm-0.1 mm and, preferably, between 0.8 mm-0.2 mm. As material, propylene styrene copolymers, polypropylene, high density polyethylene, low density polyethylene, as well as paper or cardboard can be used, wherein in particular paper or cardboard with a water impermeable layer adjoining the recess is preferred. These materials can also be used for providing the cover member. In a preferred embodiment, the cover member realized as cover layer has an additional aluminum layer adjoining the inside space of the recess. The cover layer can have the same thickness like the bowl or can have a thinner thickness, for example less than 500 μm, less than 200 μm, less than 100 μm, or less than 50 μm. In a particularly preferred embodiment, multilayered cover layers are used, for example with an aluminum barrier foil sandwiched between two layers of plastics, for example a layer of polyester on one side and a layer of polyethylene on the other side of the aluminum layer. Such a typical multilayer can be formed of the following sequence of layers: 10-20 μm polyester/10-20 μm aluminium/80-120 μm LDPE.

The recess, or the bowl forming the recess, can further comprise or can be attached to a handle made of the same or a distinct material. In a preferred embodiment, the handle is part of the bowl forming the recess, the bowl and the handle being formed of one piece of moulded plastics. Alternatively, the handle can be attached to the bowl at the outer rim, for example at the surface of the outer rim opposed to the attachment surface of the cover member.

In a preferred embodiment, the introduction of water into a recess is supported by providing means for pressure balance which allow gas to escape from the recess when water enters the recess. These means are provided by at least one channel connecting the recess with the exterior of the device. The channel extends through the rim, preferably at the interface between the cover member and the rim, i.e. in form of at least one groove in the surface of the rim abutting to the cover member. The channel traverses the rim, comprises an end within the recess and outside of the rim and is advantageously open towards the side of the rim at which the cover extends. In an alternative, the at least one channel traverses the recess. The channel is provided at a side of the recess which is opposite to a side of the device suited to be immersed into water first when preparing the substance for ingestion.

In a particularly preferred embodiment, the device comprises a handle. In this case, the side of the device opposite to the handle is suited to be immersed into water first. The at least one channel is arranged on the handle, in particular at the end of the handle which abuts to the rim. The at least one channel is provided as at least one groove on the side of the handle on which the cover is arranged on the rim (i.e. the upper surface). Further, the at least one channel extends through the upper surface of the rim, traverses the rim and extends on an end section of the handle. The end section of the handle, in particular a front face of the handle directed towards the recess forms a part of the outer rim. The at least one channel extends through this part of the outer rim and allows air to exit the recess when water (of any other fluid) enters the recess through the openings.

The at least one channel extends through the outer rim, wherein the channels provide a fluid connection between the recess and the exterior of the device. Sections of the at least one channel are provided on a surface of the handle (or, as an alternative, within the handle). The at least one channel extends through an interface between the cover member and the rim. In general, all combinations of these constructions relating to the at least one channel implement the invention.

The cover member comprises an outer surface opposed to an inner surface adjoining the recess or the inside space of the recess. In this way, the cover member, i.e. the inner surface and the recess encompass a space with a volume of typically 1.25 ml. The volume encompassed by the recess and by the cover member can be 20 ml-0.5 ml, preferably 15 ml-2 ml, or 8 ml-5 ml. Smaller embodiments provide a volume of 0.1 ml-2 ml, 0.3 ml-1.5 ml, or 0.5 ml-1.25 ml. The volume depends on the dosage form of the composition inside the recess and, consequently on the desired therapy form. In this view, the cover member has preferably a volume greater than the volume filled by the composition which allows an additional free space in the recess for the extending composition when brought into contact with water.

The openings in the cover member can be provided in form of slits (openings with an aspect ratio greater than for example 50 or 200, the width of which is smaller than 2 mm, 1 mm and, preferably smaller than 0.5, 0.2 or 0.1 mm. Other forms of openings are perforations which can be ovoid, rectangular, circular or square. In general, any shape is possible as long as the openings still retain all composition particles. According to a further embodiment, the openings are provided by meshes of a grid forming the cover layer. In this embodiment, the cover layer is a net the apertures of which form the openings. This embodiment provides a plurality of periodically arranged openings provided by meshes which are the apertures of textile fibres, which are woven, or braided, or joined by connections at each crossing point of the fibres. Other embodiments are punched layers, the punching points of which are repeated periodically thereby forming the apertures providing the openings of the cover layer. Alternatively, only one, two or few punching points provide the opening or the openings, respectively. Other embodiments comprise a cover layer formed of fabric, for example filament fabric.

These types of openings, i.e. slits, perforation, meshes of a grid, can be used individually to provide the inventive cover member, or can be used in any combination. In general, the size of the openings is adapted to the particle size of the composition and vice versa as described in the following in detail.

The composition comprises at least one gelling agent and at least one pharmaceutically active composition. The active agent is provided as at least one a pharmaceutical or nutritive substance for oral administration. The gelling agent absorbs liquids, in particular water upon contact which leads to swelling of the gelling agent, consequently, of the composition. As liquid, any material capable of flowing is considered with the property of provoking swelling or gelling of the gelling agent. The gelling agent comprises a hydrogel or a soluble polysaccharide, for example Gellan gum. The gelling agent and/or the active agent can further comprise additives ensuring or enhancing the water absorption by the gelling agent. In particular, the gelling agent has preferably a high specific surface area, for example by providing pores. The gelling agent (as well as the substance) is/are preferably formed as small particles as bulk material which inherently allows good water absorption and mixture with water. However, the particles forming the composition have a size, for example the smallest dimension of the particle, which is larger than the smallest dimension of the opening or the smallest dimension of the smallest opening, if a plurality of openings is provided in the cover member. Preferably, the particle size of the gelling agent and of the active agent is greater than 0.2 mm, 0.5 mm, 1 mm or 2 mm. The composition can be provided in granular form, microcapsules or as pellets. In a preferred embodiment, the active agent, as well as all optional additives are formed as a core covered by a layer provided by the gelling agent. In this embodiment, the recess only contains particles which are covered by the gelling agent. Alternatively, the complete composition is provided as particles of active agent covered by gelling agents, the recess containing particles of active agent, covered by the gelling agent, together with particles comprising the gelling agent or the active agent. In any case, any particles within the recess have a size greater than the clearance of the openings, i.e. the dimensions of the openings. In other words, the size of the openings in relationship to the particles providing the composition is suitable for retaining substantially all of the composition within the recess.

The openings can be free of any materials, thus providing a fluidic connection before and after contact of the device with water. In an alternative embodiment, water-dissolvable material obstructs all openings or at least a part of the openings, for example in form of a water-dissolvable layer covering the openings as well as at least a part of the cover member or cover layer. In addition or as an alternative, the openings themselves are obstructed with water-dissolvable material, for example material of the water-dissolvable layer. The water-dissolvable layer can be formed of material similar to the gelling agent. As an alternative, the water-dissolvable material comprises water-soluble cellulose, HPMC or a combination thereof. In addition, water-soluble polysaccharides can be used alone or in any combination with the above-mentioned water-dissolvable materials to provide the water-dissolvable material. In particular, modified starch, sugars (e.g. as impermeable pressed block of sugar particles), caramel, or blends thereof can be used as water-dissolvable material. In particular, the water-dissolvable material comprises a water soluble compound, preferably a water soluble polymer or mixtures of two or more of these compounds. The water-dissolvable material may for example comprise polyethylene glycol, polylactic acid, water soluble cellulose, such as hydroxypropylmethyl cellulose, hydroxypropyl cellulose, hydrolysed gelatine or mannite or a mixture of two or more thereof. Furthermore, the water-dissolvable material may comprise: sugars, such as saccharide, lactose, fructose, polylactide, starch, modified starch, starch derivatives, cellophane or any blends thereof. These and the above mentioned materials can be used individually to provide the water-dissolvable material or they can be used in any combination. Preferably, the water-dissolvable material consists essentially of one or more of theses compounds. The water-dissolvable material is in form of an impermeable layer block, layer, or plug.

In another preferred embodiment, the cover member is attached to the rim of the recess by an adhesive bond being not dissolvable in water or being substantially less dissolvable in water in comparison to the water-dissolvable material forming the water-dissolvable layer. In the embodiments having the openings obstructed by water-dissolvable material, the composition can be provided as powder in any particle size or at least in a particle size greater than the clearance of the openings, the particle size being related to composition particles which have been already in contact with water.

By the water-dissolvable material obstructing the openings, the recess is completely closed and, upon contact with water, water enters the recess and contacts the composition and in particular the gelling agent. In particular, in case of small particle sizes, for example if the composition is provided as powder, the water entering the recess is nearly immediately absorbed by the powder particles which also nearly immediately expand and/or connect to neighboring particles. In this way, the composition is provided in a form which is retained by the openings (which are now cleared from the water-dissolvable material) such that even particles which are smaller (in dry form) than the openings are retained by the openings.

Due to the small particle size and the resulting high specific surface area, the absorption process is preformed nearly immediately such that the water flow cannot remove the composition through the openings even if the water entering the recess is nearly immediately redirected back to the openings of the cover member.

In a particular embodiment, all openings are obstructed by water-dissolvable material sealing the cover member to a continuous layer, wherein the cover member is sealed to the recess. In this regard, the term "sealed" means that no pressure compensation between inside the recess and the outside is possible. The recess is filled with the composition, together with gas at vacuum, i.e. a pressure lower than the air pressure of the air surrounding the device. Upon contact with water, the water-dissolvable material is dissolved providing a free flow between the outer surrounding and the inside of the recess. Since water is already present at the openings for dissolving the water-dissolvable material, the water is drawn into the recess by the pressure compensation between the vacuum inside the recess and the outside atmosphere. In this way, water enters the recess and contacts the gelling agent. Preferably, this device is used by immersing the device, in particular at least one of the openings in water and maintaining this opening immersed into water until the pressure compensation is completed.

Further, the invention comprises a method for manufacturing the device as described above by providing a bowl forming the recess, arranging a solid composition in the recess, the composition comprising a gelling agent, attaching the cover member to the device, the cover member covering the recess thereby enclosing the composition in the recess. In addition, the method comprises to provide the cover member with openings as described above, for example by attaching a cover member to the recess which already comprises openings as described above, or by providing the openings into the cover member after the cover member has been attached to the recess.

The openings can be provided by cutting, perforating, punching or drilling. As an alternative, the cover member can be formed as a grid having meshes as described above.

In a preferred embodiment of the manufacturing method, the water-dissolvable material as described above is added to the device by applying the water-dissolvable material onto and/or into the openings. For example, a water-dissolvable layer can be applied onto the openings. For providing an embodiment in which the recess is under vacuum, the cover member can be applied onto the recess, followed by a step of applying vacuum to the recess and by obstructing the openings, i.e. sealing the openings with water-dissolvable material. The water-dissolvable material is applied on the openings during the application of vacuum to the recess. In a particular embodiment, the water-dissolvable material obstructing or sealing the openings is provided as water-dissolvable layer, whereby the water-dissolvable material is dissolved in water, the resulting solution is applied into or onto the openings and preferably also onto the cover member. Subsequently, the solution is dried, preferably during application of vacuum to the inside of the recess. For example, the solution comprising the water-dissolvable material is applied onto the cover member in a vacuum chamber in which the device is located. Then the solution comprising the water-dissolvable material is dried inside the vacuum chamber (for example supported by heating). After having dried the solution comprising the water-dissolvable material, the device is removed from the vacuum device, the vacuum inside the recess remaining due to the complete sealing of the recess by the cover member and the water-dissolvable material obstructing or sealing the openings. The water-dissolvable material can be applied onto the cover member as a solution and by blade-coating the solution after application onto the outer surface of the cover member. This step of applying the water-dissolvable material can be combined with a step of applying vacuum to the recess, or not. In another embodiment, the vacuum in the recess is provided by applying vacuum to the recess after the recess has been sealed by the cover member (and the water-dissolvable material) by introducing a tube into the recess, preferably through the bowl or through the cover member, applying vacuum to the inner space of the recess through the tube and by sealing the puncture/opening resulting from the introduction of the tube immediately after or during removal of the tube. The puncture resulting from introduction of the tube can be sealed in a vacuum atmosphere, for example by an adhesive film or even by applying a water-dissolvable material for sealing the opening resulting from the puncture.

In general, if the inner space of the recess is under vacuum or if vacuum is applied to the recess, the cover member is preferably sealingly attached to the recess, in particular to the outer rim of the recess. In a preferred embodiment, the outer rim of the recess extends substantially along a plane which allows for a simple sealing process by attaching the cover member. In general, the vacuum is applied to the inside of the recess during or after sealing the recess.

The composition in the recess can have any form, for example particles or small slices or any other shape providing that the composition is retained by the cover member. The composition formed as particles can be loosely filled in the recess or can be completely or partly attached to the inner surface of the recess by an adhesive bond. The adhesive bond can be provided by the gelling agent or by other adhesive compounds.

In a preferred embodiment, the device is completely surrounded by a packaging, e.g. a packaging foil. The packaging foil encloses only one single device. The packing foil can be filled with gas under vacuum. The gas can be air or an inert gas like nitrogen or carbon dioxide stabilizing the composition and preventing disintegration of compounds within the composition, e.g. compounds providing the composition. In another embodiment, gas is provided within the recess directly contacting the composition, the gas being an inert gas like nitrogen or carbon dioxide stabilizing the composition and preventing disintegration of compounds within the composition, e.g. compounds providing the composition. The gas within the recess can be under standard pressure or under vacuum pressure. In a particular embodiment, the device is surrounded by a packaging foil and the packaging foil delimits a first atmosphere under vacuum. In this particular embodiment, the cover layer completely seals the recess (all openings of the cover member are sealed with water-dissolvable material) and the atmosphere within the recess denoted as the second atmosphere, is under vacuum. The pressure of the second atmosphere is equal to or lower than the pressure of the first atmosphere.

In this way, an embodiment of the inventive method comprises the step of enclosing and sealing the device (or the recess) with the packaging. In an optional step, the space enclosed by the packaging is provided with vacuum pressure and/or comprises air, an inert gas, nitrogen or carbon dioxide.

The invention covers two particular embodiments, in both of which the retaining element ensures to avoid any loss of the agent during preparation. According to the first embodiment, the cover member has at least one opening, which provides a fluidic connection through the cover member before, during (and after) introduction of the liquid into the recess. In this first embodiment, the at least one opening is cleared. According to the second embodiment, the cover member has at least one opening, which provides a fluidic connection through the cover member during (and after) introduction of the liquid into the recess. In this second embodiment, the at least one opening is sealed by a water-dissolvable layer on the at least one opening or a water-dissolvable plug within the at least one opening. Upon contact with liquid containing water, the water-dissolvable layer or plug is dissolved, which clears the opening and provides a fluidic connection through the cover member. In this context, the layer or plug is water-dissolvable and can be dissolved by the liquid, the liquid comprising water. Embodiments of the invention can comprise at least one opening according to the first embodiment and at least one other opening according to the second embodiment.

DESCRIPTION OF THE DRAWINGS

Figure 1:
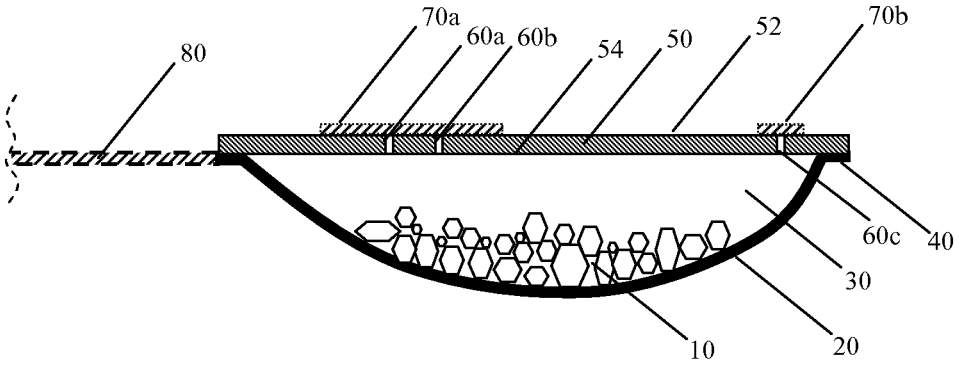
FIG. 1 is a cross-section of a first embodiment of the device according to the invention.

FIG. 1 shows a device for oral application of a composition 10 comprising a bowl 20, which forms a recess. The recess 30 formed by the bowl 20 is (at least partly) in concave shape. The ends of the recess, i.e. the ends of the bowl are formed as an outer rim 40 completely encompassing the end of the recess. On the outer rim 40, a cover member 50 provided as a cover layer is attached. Preferably, the attachment of the cover member 50 to the rim 40 is a sealing connection. The cover layer 50 providing the cover member has an outer surface 52, which is opposed to an inner surface 54 of the cover layer 50. In other words, the outer surface 52 of the cover layer adjoins the outer atmosphere of the device and the inner surface 54 of the cover layer adjoins to the inner surface of the recess and encloses, together with the inner surface of the bowl 20, the recess 30. In the cover layer 50, openings 60*a* to 60*c* are provided which provide a connection between the inner surface 54 and the outer surface 52.

As described above, it is not necessary to obstruct or seal the openings to carry out the invention. However, in a particular embodiment, the cover layer, in particular the openings in the cover layer 60*a* to 60*c*, are sealedly covered by a water-dissolvable layer (70*a, b*). In FIG. 1, the openings 60*a* and 60*b* both are sealed by the water-dissolvable layer 70*a*. In general, more than one opening can be sealed by one and the same water-dissolvable layer. However, as shown with 70*b*, also only one opening 60*c* can be sealed with one water-dissolvable layer 70*b* dedicated thereto. The embodiment shown in FIG. 1 shows three openings 60*a* to 60*c*. However, also only one opening can be provided in the cover layer 50. In another example, only the openings 60*a* and 60*c* can be provided and being spaced from each other. In particular, if one of the openings is located close to the outer rim, in FIG. 1 opening 60*c*, the other opening, for example opening 60*a* or 60*b*, can be used for air pressure compensation if the device is immersed into water at the section of the device comprising the opening 60*c*. In this case, water enters through the opening 60*c* and one of the openings 60*a* or 60*b*, or both, which can be used for pressure compensation resulting from the water entering the recess 30. Such an embodiment having two openings substantially spaced apart from each other preferably does not comprise water-dissolvable layers 70*a* or 70*b* or comprises at least one opening which is not sealed by water-dissolvable material, which is used for pressure compensation and, consequently, is not in contact with water when the device is partially immersed in water.

Further, the device can also comprise a handle 80, which is connected to the bowl 20 forming the recess. If the embodiment comprising the handle 80 is combined with the embodiment described above having two openings 60*a*, 60*c* being spaced from each other, one of the openings, for example opening 60*a*, is preferably located nearby the handle 80, whereas the other opening is located at the opposite end of the cover member, i.e. at the other side of the bowl. Since the device is held by the handle 80 during immersion, the end of the bowl opposite to the handle 80 is immersed first into water and the end of the bowl close to the handle 80 remains above the water surface, if the bowl is not completely immersed into water. Even if the bowl 20 is immersed completely into the water and the opening 60*a* close to the handle 80 lies beneath the water surface, opening 60*a* still provides an outlet for air which is removed from the recess by the water entering the opening 60*c*. This allows the water to enter into the recess through opening 60*c*, opening 60*a* allowing pressure compensation leading air to the outside.

As shown in FIG. 1 in form of symbols, the composition 10 is provided as particles with different particle sizes and shapes. However, the particle size of all particles is always greater than the clearance of the openings 60*a*-60*c* such that it is guaranteed that the composition is completely retained in the recess by the cover member 50. In this regard, for example opening 60*b* can be formed as a slit (extending perpendicular to the plane of projection) such that the width of the opening as shown in FIG. 1 is smaller than the particles. The particles are retained, even if the slit is multiple times longer than the width. Thus, the smallest dimension of the openings provides the clearance of the openings, which is smaller than the smallest particle size.

Figure 2:
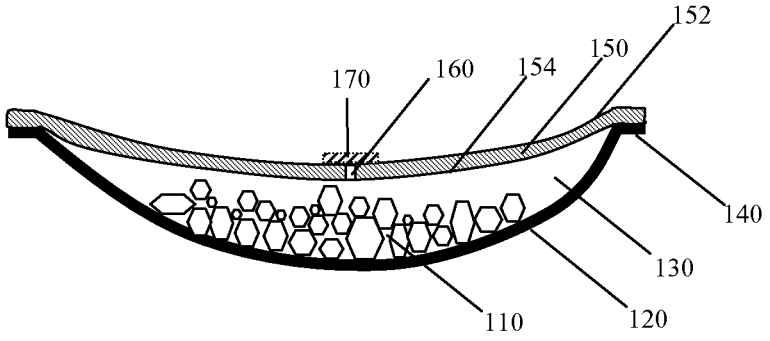
FIG. 2 is a cross-section of a second embodiment of the device according to the invention.

In FIG. 2, a second embodiment of the device according to the invention is shown in cross-section, the device comprising a recess 130 formed by a bowl 120, in which a composition 110 is located. The recess 130 and therewith the bowl 120 end in an outer rim 140 to which a cover layer 150 is sealingly attached. The cover member 140 comprises an inner surface 154 adjoining the recess 130 and, opposed thereto, an outer surface 152 adjoining the outer atmosphere of the device. The cover member 150 comprises an opening 160 which is sealingly obstructed by a water-dissolvable layer 170. In the recess 130, the composition as well as gas surrounding the composition 110 is provided. The gas provides a vacuum inside the recess 130, i.e. the gas in the recess 130 has a lower pressure than the atmosphere surrounding the device, i.e. the gas contacting the outer surface 152. In this embodiment, the water-dissolvable material is formed as a water-dissolvable layer 170, which sealingly obstructs the opening 160. Thus, the vacuum is maintained by the sealing connection between rim 140 and cover layer 150 and by the water-dissolvable layer 170 covering the opening 160. In another embodiment (not shown) a part of the water-dissolvable material or all of the water-dissolvable material is located within the opening. Since in FIG. 2, the cover layer 150 is formed of flexible material (for example thin layers of plastics or of laminated plastics/aluminium sheets), the cover layer 150 is bound towards the recess 130. Upon contact of water with the opening and the water-dissolvable layer 170 (for example by immersing the bowl 120 into water), the water-dissolvable layer 170 is dissolved and opens opening 160. Since the recess is under vacuum, amongst others by the elastic properties of the cover layer 150, water is drawn into the recess 130 by pressure compensation through the opening 160. The pressure compensation through opening 160 relieves the tension on the elastic cover member 150 which returns to its original state (i.e. extending within the rim along a plane), thereby increasing the volume of the recess.

According to the embodiment of FIG. 2 the composition is not only retained by the opening 160 but also by the water-dissolvable layer 170. Thus, the particles forming the composition 110 can be of smaller size than the clearance of the opening 160. Since the water entering the recess flows through the opening 160 in a direction towards the recess 130, the particles forming the composition 110 are retained within the recess by the water flow, which lasts until the pressure compensation is completed. The pressure compensation is not carried out immediately but takes a view seconds. Therefore, the particles forming the composition 110 can expand due to the contact with the water having entered the cavity and, after having completed the pressure compensation, cannot leave the cavity through the opening 160 since their size has increased by absorbed water. In addition, the water absorption leads to adhesive bonding between the particles which also prevents the particles from leaving the recess through the opening 160.

Figure 3A:
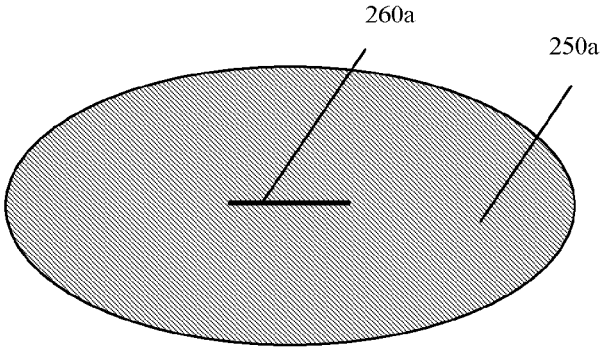
FIGS. 3A to 3C are illustrations of embodiments of the inventive cover member in top view.

In FIG. 3A, a cover layer of the inventive device is shown in top view comprising a cover layer 250*a* and a slit 260*a* which provides the opening. The line thickness of the slit 260*a* corresponds with the clearance of the opening. The opening 260*a* shown in FIG. 3A can be provided by a cut, for example using a blade or a knife. Preferably, the cut is carried out before attaching the layer to the bowl forming the recess, however, before an optional water-dissolving layer is applied onto the slit 260*a* as well as the area of the layer 250*a* surrounding the slit 260*a*.

Figure 3B:
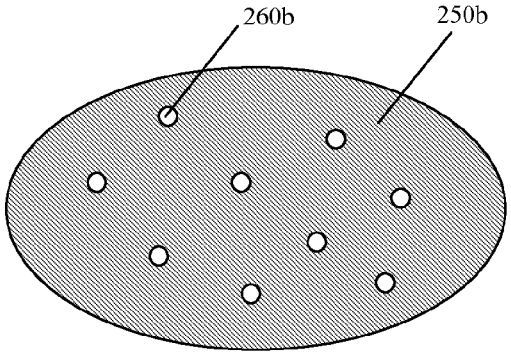

In FIG. 3B, an alternative cover layer 150*b* is shown in top view, which is used to cover the device according to the invention. The cover layer 250*b* comprises openings 260*b*, which are carried out as perforations. The perforations have a circular cross-section, for example provided by needles punched into the cover layer 250*b*. Like in FIG. 3A, the cover layer shown in FIG. 3B is ovoid, according to the shape of the outer rim of the recess formed by the bowl. In particular, shapes known from bowls of common spoons are preferred as shape for the outer rim and, consequently, as shape for the cover member.

Figure 3C:
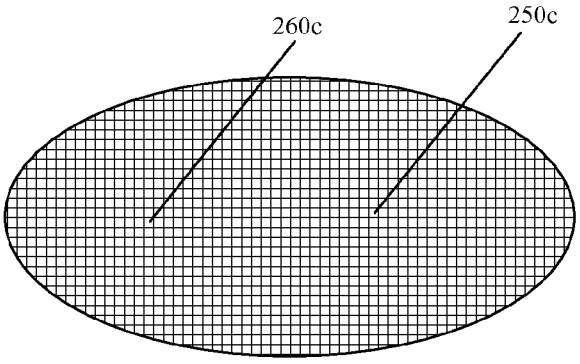

In FIG. 3C, a preferred embodiment of the cover layer 250*c* is shown for covering the outer rim of the recess formed by the bowl of the device according to the invention. The cover layer 260*c* is provided by a grid. The grid is formed of hollow fibres extending in two different directions. In FIG. 3C, the directions are perpendicular to each other forming a rectangular grid pattern of fibres or fabric between which meshes are formed leaving openings 260*c* between the fibres providing the cover layer 250*c*. The cover layer 250*c*, together with the openings 260*c*, can be provided without a water-dissolvable layer or with a water-dissolvable layer. In case of the use with a water-dissolvable layer, this is applied onto the layer 250*c* by applying a free-flowing solution of water-dissolvable material in water, which is applied over the complete outer (or inner) surface of the cover layer 250*c* during or after applying the solution, the solution is distributed, for example by blade coating. After having applied the free-flowing solution of water-dissolvable material in water, the solution is dried. The remaining material obstructs the opening formed by the meshes of the grid forming the cover layer 250*c*.

REFERENCE SIGNS

10, 110 substance
20, 120 bowl
30, 130 recess
40, 140 outer rim
50, 150,
150*a-c*, 250*a-c* cover member, cover layer
52, 152 outer layer of the cover layer
54, 154 inner surface of the cover layer
60, 160, 260*a-c* openings
70*a, b*, 170 water-dissolvable layer
80 handle

The invention claimed is:

1. A device for oral application of a composition, said device comprising:

a recess having an outer rim encompassing the recess;

a composition arranged within the recess, the composition comprising at least a gelling agent and an active agent, wherein the composition being provided as a plurality of solid particles, each having a particle size;

a cover member having an inner surface attached to the outer rim by a sealing connection extending along a complete circumference of the rim and the cover member completely covering the recess, the cover member, together with the recess, retaining the composition within the recess, the cover member having an outer surface opposed to the inner surface of the cover member adjoining the recess, wherein the cover member comprises one or more openings for providing fluidic connection between the inner surface and the outer surface of the cover member; and a water-dissolvable layer sealing the one or more openings, wherein all of the at least one openings have a clearance smaller than a minimum of the particle sizes in order to retain all particles within the recess by the one or more openings of the cover member, wherein the cover member is adapted to be removed after preparation of the composition and right before oral application.

2. The device for oral application according to claim 1, wherein the one or more openings comprise one or more slits, one or more perforations, or the one or more openings are provided by meshes of a grid forming the cover layer.

3. The device for oral application according to claim 1, wherein the one or more openings provides a fluidic connection between the inner surface and the outer surface connecting the recess with the outside of the device.

4. The device for oral application according claim 1, the recess containing gas surrounding the composition, the gas providing a vacuum inside the recess.

5. The device for oral application according to claim 1, further comprising a bowl providing the recess as well as a handle connected to the bowl, the handle and the bowl together forming a spoon.

6. The device according to claim 5, wherein the cover member consisting essentially of a thin layer having an inner surface, the outer rim has a surface opposing the inner surface of the thin layer, and the thin layer is only connected to the outer rim at the outer rim surface opposing the inner surface of the thin layer so that the thin layer covers the recess.

7. A method for manufacturing the device according to claim 1 comprising the steps:

providing a bowl forming the recess and the outer rim encompassing the recess;

introducing the composition into the recess;

attaching the cover member to the rim, thereby completely covering the recess by the cover member, wherein the step of attaching comprises arranging the cover member with the inner surface of the cover member adjoining the recess and the outer surface of the cover member opposing the recess;

completely enclosing the composition by the cover member and the bowl thereby retaining the composition completely within the recess; and providing the cover member with one or more openings, the one or more openings being adapted for providing fluidic connection between the inner surface and the outer surface of the cover member, and a water-dissolvable layer sealing the at least one opening, wherein all one or more openings have a clearance smaller than a minimum of the particle sizes in order to retain all particles within the recess by the one or more openings of the cover member.

8. The method for manufacturing according to claim 7, comprising the step of forming the one or more openings in the cover member by cutting, perforating, punching, drilling or by providing the cover member as a grid having meshes, the meshes forming the openings.

9. The method for manufacturing according to claim 7, further comprising sealing the one or more openings with a water-dissolvable layer by applying the water-dissolvable layer on the openings, and sealingly attaching the cover member to the rim along the complete circumference of the rim, thereby sealing the inside of the recess.

10. The method for manufacturing according to claim 8, wherein a vacuum is applied to the inside of the recess during or after sealing the recess.

11. A method for oral application of a composition, comprising the steps of:

(a) providing the device according to claim 1;

(b) dissolving the water-dissolvable layer and conducting water through the one or more openings of the cover member into the recess and exposing the composition to the water, the composition absorbing at least a part of the water during exposure;

(c) orally applying the composition to a patient after completing step (b), wherein the cover member is removed after step (b) is completed.

12. The method for oral application according to claim 11, further comprising the step: (d) dissolving a water-dissolvable layer sealing the at least one of the openings by immersing the device in water before or upon initiating step (b).

13. The method for oral application according to claim 12, further comprising: (e) providing a vacuum within the recess, the cover member completely sealing the recess; wherein step (b) comprises drawing water into the recess by pressure compensation of the vacuum and the outer atmosphere upon at least partly dissolving the water-dissolvable layer clearing at least one of the openings.

14. The method for oral application according to claim 11, wherein at least one of the openings of the device is immersed in water at least until water has entered the recess.

* * * * *